US008904950B2

(12) United States Patent
Jackson

(10) Patent No.: US 8,904,950 B2
(45) Date of Patent: Dec. 9, 2014

(54) REMOVABLE GLIDE ASSEMBLY FOR A WATERCRAFT FLOAT

(76) Inventor: Jeffery Jackson, Chapin, SC (US)

( * ) Notice: Subject to any disclaimer, the term of this patent is extended or adjusted under 35 U.S.C. 154(b) by 0 days.

(21) Appl. No.: 13/421,850

(22) Filed: Mar. 15, 2012

(65) Prior Publication Data

US 2013/0239865 A1 Sep. 19, 2013

(51) Int. Cl.
*B63B 35/44* (2006.01)

(52) U.S. Cl.
USPC ..... 114/263

(58) Field of Classification Search
USPC ..... 114/263; 405/1–7
See application file for complete search history.

(56) References Cited

U.S. PATENT DOCUMENTS

| | | | | |
|---|---|---|---|---|
| 3,734,046 | A * | 5/1973 | Schmidt et al. | 114/259 |
| 6,612,775 | B1 * | 9/2003 | Hewitt | 405/3 |
| 7,069,872 | B2 * | 7/2006 | Ostreng et al. | 114/263 |
| 7,552,495 | B1 * | 6/2009 | Rogerson | 14/69.5 |

FOREIGN PATENT DOCUMENTS

GB 2075923 A * 11/1981 ..... B63C 3/00

* cited by examiner

*Primary Examiner* — Edwin Swinehart
(74) *Attorney, Agent, or Firm* — The Law Offices of Eric W. Peterson

(57) ABSTRACT

The present disclosure pertains to a glide assembly for a watercraft float having a base with a bottom surface substantially mated to a watercraft receiving area of the float and a cavity, a glide member, an axle, and a securing mechanism allowing for the glide assembly to be positioned at different locations on the float, where the glide assembly reduces the amount of force required to receive and launch the watercraft.

9 Claims, 4 Drawing Sheets

REMOVABLE GLIDE ASSEMBLY FOR A WATERCRAFT FLOAT

BACKGROUND

Drive-on watercraft floats that allow for a watercraft to dock are well known. The watercraft is driven onto the float within a watercraft receiving area to receive the hull of the watercraft. Drive-on watercraft floats lift the watercraft out of the water thereby reducing damage to the watercraft caused by the watercraft from being stored in the water, allowing for the watercraft to be more easily services, and allowing for the watercraft to be easily boarded and disembarked by the user. Watercraft floats are fitted to a single size watercraft and are not versatile allowing them to be used for multiple sized watercrafts. Launching the watercraft from the watercraft float is often difficult and can lead to injury of the user.

SUMMARY OF THE INVENTION

The present disclosure pertains to a glide assembly for a watercraft float having a base with a bottom surface and a cavity, a glide member, an axle, and a securing mechanism allowing for the glide assembly to be positioned at different locations on the float, where the cavity receives the glide member and axle. In one aspect of the disclosure, the bottom surface is substantially mated to a watercraft receiving area of the float. In one aspect of the disclosure, the contour of the bottom surface of the base has the shape of a multi-tiered angled protrusion, and the contour of the surface of a watercraft receiving area of the float has the shape of a multi-tiered angled recess. In one aspect of the disclosure, the contour of the surface of the glide member is concave towards the center of the glide member.

In one aspect of the disclosure, the securing mechanism has a threaded float cavity located within the float, an assembly tunnel located within the glide assembly, and a fastener. In one aspect of the disclosure, a plurality of threaded float cavities are located along the longitudinal axis of a watercraft receiving area of the float. In one aspect of the disclosure, the plurality of threaded float cavities are positioned between about 6"-48" apart.

In one aspect of the disclosure, the surface of the glide assembly that contacts the watercraft is located above the surface of the watercraft receiving area thereby reducing the amount of force required to launch the watercraft.

In one aspect of the disclosure, the surface of the glide assembly that contacts the watercraft is located between about 1"-24" above the surface of the watercraft receiving area.

With those and other objects, advantages and features on the invention that may become hereinafter apparent, the nature of the invention may be more clearly understood by reference to the following detailed description of the invention, the appended claims, and the drawings attached hereto.

BRIEF DESCRIPTION OF THE DRAWINGS

The accompanying drawings, which are incorporated herein and form part of the specification, illustrate various embodiments of the present invention and together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION

In the following detailed description, reference is made to the accompanying drawings which form a part hereof and in which is shown by way of illustration specific embodiments in which the invention may be practiced. These embodiments are described in sufficient detail to enable those skilled in the art to practice the invention, and it is to be understood that other embodiments may be utilized and that structural or logical changes may be made without departing from the scope of the present invention. The following detailed description is, therefore, not to be taken in a limiting sense, and the scope of the present invention is defined by the appended claims.

Figure 1:
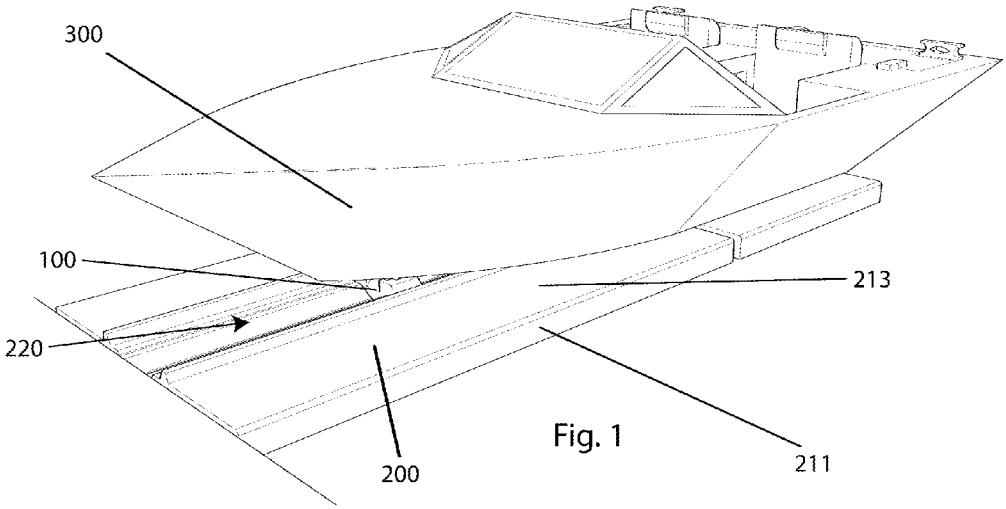
FIG. 1 is a perspective view of a glide assembly according to an exemplary embodiment used in relation to a float and watercraft.
Figure 2:
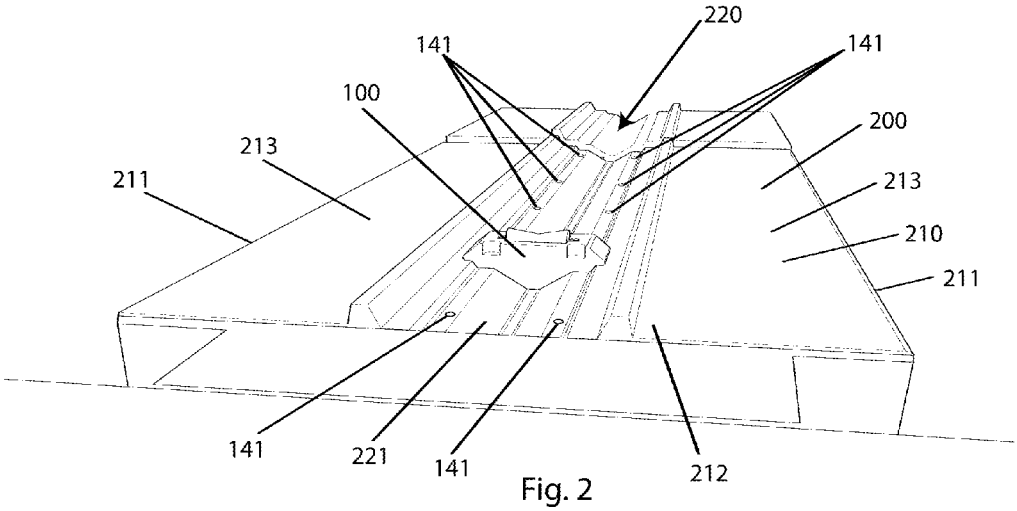
FIG. 2 is a perspective view of a glide assembly according to an exemplary embodiment use in relation to a float.
Figure 3:
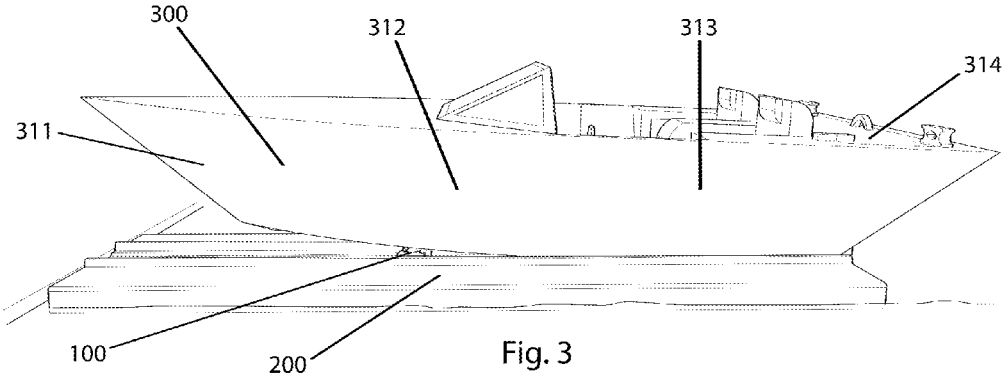
FIG. 3 is a perspective view of a glide assembly according to an exemplary embodiment used in relation to a float and watercraft.

The present disclosure pertains to a glide assembly 100 removably engaged to a drive-on watercraft float 200 for receiving a watercraft 300. As shown in FIGS. 1-3, the float 200 can have a deck surface 210, sides 211, and a watercraft receiving area 220 with a surface formed in the deck surface 210. The watercraft receiving area 220 is substantially centered between sides 211 allowing for a bow 311 deck section 212 and side deck sections 213. The surface 221 of the watercraft receiving area 220 can have any shape that allows the float 200 to receive a watercraft 300, for example, concave, angled recess, multi-tiered angled recess, or the like. The watercraft receiving area 220 opens at the rear of the float 200 to receive a watercraft 300. The float 200 can be sized to receive a small watercraft 300, such as a personal watercraft or small boat, or sized to receive a larger watercraft, such as a speed boat. The watercraft 300 can have multiple sections including a bow 311, middle front 312, middle rear 313, and stern 314.

Figure 4:
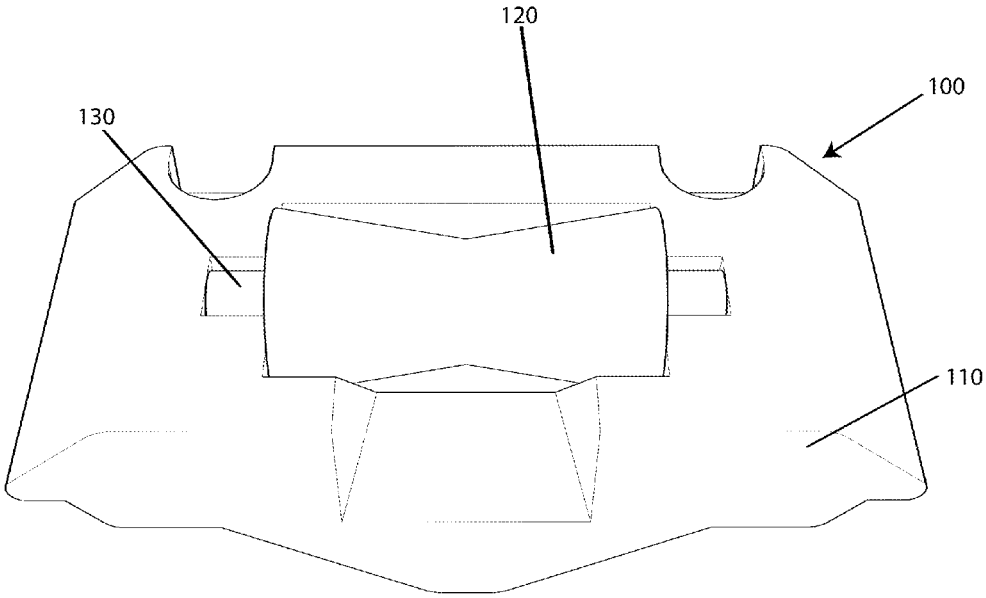
FIG. 4 is a perspective view of a glide assembly according to an exemplary embodiment.
Figure 5:
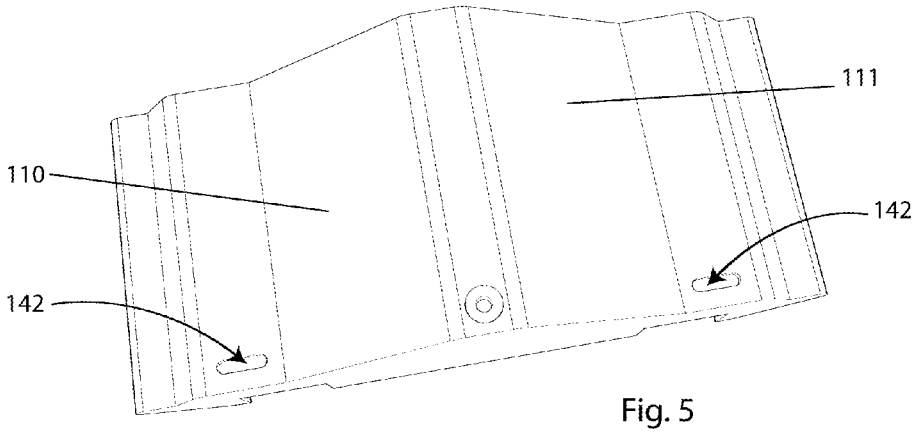
FIG. 5 is a bottom view of a base according to an exemplary embodiment.
Figure 6:
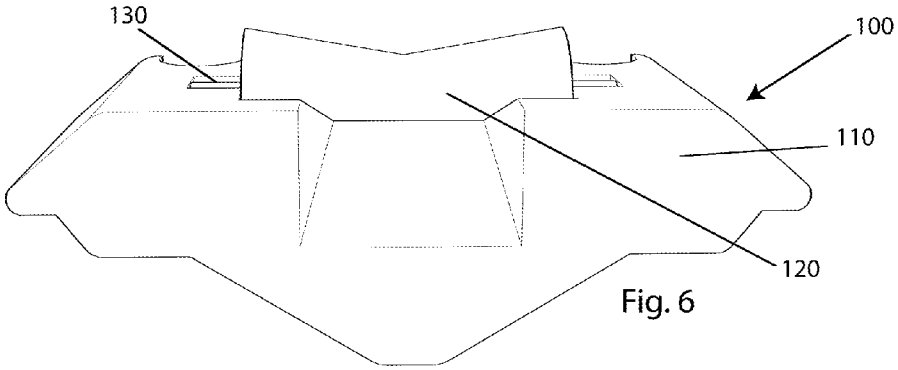
FIG. 6 is a side view of a base according to an exemplary embodiment.

In one embodiment, as shown in FIG. 4-6, the glide assembly 100 has a base 110, glide member 120, and axle 130. The base 110 has a bottom surface 111 for contacting the watercraft receiving area 220 and a cavity 112 for receiving the glide member 120 and axle 130. The bottom surface 111 can have any contour that allows for the base 110 to be substantially mated to the watercraft receiving area 220. For example, where the surface of the watercraft receiving area 220 is substantially concave, the bottom surface 111 of the base 110 is substantially convex thereby allowing for the bottom surface 111 of the base 110 to be substantially mated to the surface 221 of the watercraft receiving area 220. By way of another example, where the surface 221 of the watercraft receiving area 220 has the shape of a multi-tiered angled recess or multi-angled track, the bottom surface 111 of the base 110 has the shape of a multi-tiered angled protrusion, thereby allowing for the recess to receive the protrusion in a manner where the bottom surface 111 of the base 110 is substantially mated to the surface of the watercraft receiving area 220. The base 110 is made of a rigid material providing support to the glide member 120 and received watercraft 300, for example, rigid plastic, wood, metal, or the like.

Figure 7:
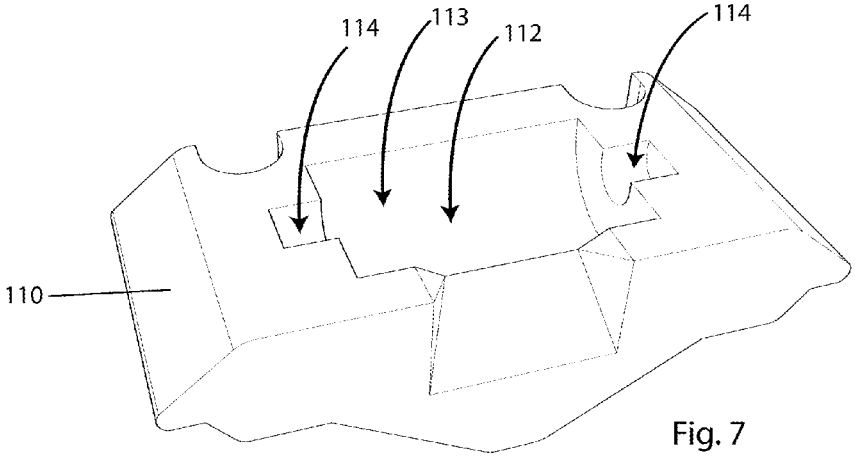
FIG. 7 is a perspective view of a base according to an exemplary embodiment.

As shown in FIG. 7, the cavity 112 can have a glide cavity 113 for receiving the glide member 120 and axle cavities 114 for receiving the axle 130. The glide member 120 is sized to be received by the glide cavity 113 and the axle 130 is sized to be received by the axle cavities 114. The glide cavity 113 and axle cavities 114 allow for the glide member 120 and/or axle 130 to rotate freely within the cavities. In one embodiment, the axle cavities 114 receive the axle 130 thereby allowing for the axle 130 to rotationally engage the base 110.

The glide member 120 allows for the glide assembly 100 to rotationally support the watercraft 300. The glide member 120 can be any component that allows for the rotation upon contact with the bottom of the watercraft 300, for example, a roller, multiple rollers with spacers, or the like. The glide member 120 can be fixedly engaged to the axle 130 or rotationally engaged to the axle 130. In one embodiment, the contour of the surface of the glide member 120 is concave towards the center of the glide member 120 to allow for the structural keel of the watercraft 300 to be centered onto the glide member 120.

Figure 8:
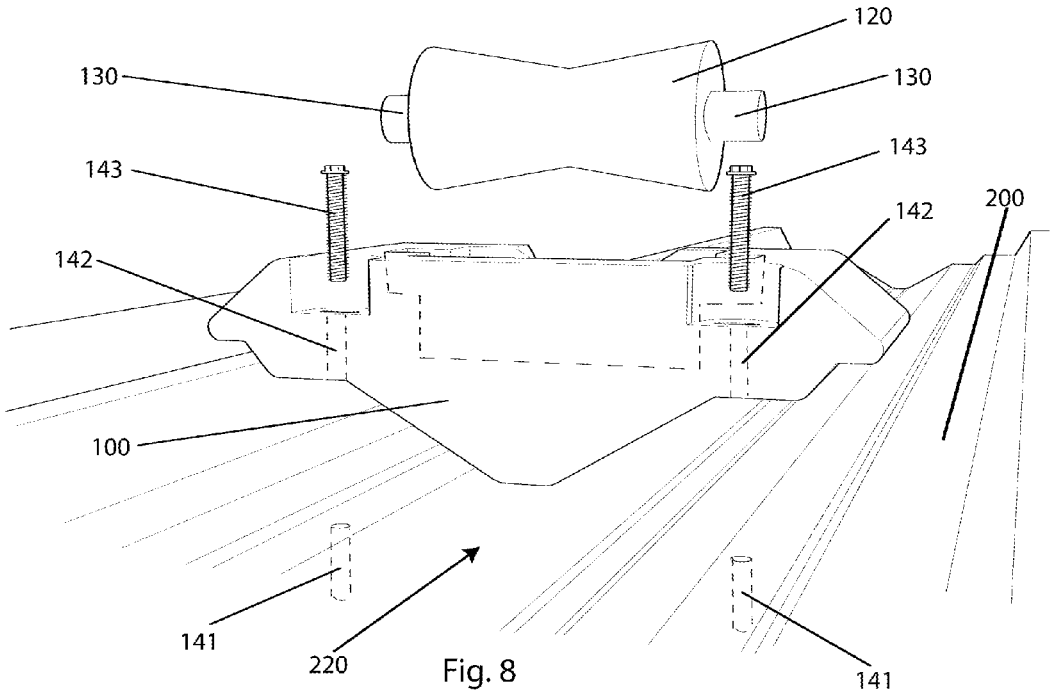
FIG. 8 is an exploded view of a securing mechanism according to an exemplary embodiment.

In one embodiment, as shown in FIG. 8, the glide assembly 100 has a securing mechanism 140 allowing for the glide assembly 100 to be secured to the float 200. The securing mechanism 140 can be any mechanism for securing a glide assembly 100 to a float 200. For example, the securing mechanism 140 can have a threaded float cavity 141 located within the float 200, an assembly tunnel 142 located within the glide assembly 100, and a fastener 143. The fastener 143 can be a screw, bolt, or the like. The fastener 143 is received by the assembly tunnel 142 and is threaded into the float cavity 141 thereby securing the glide assembly 100 to the float 200. By way of another example, the securing mechanism 140 can have a protrusion and slot (not shown) where the protrusion is snapped into the slot.

In one embodiment, the glide assembly 100 has a plurality of securing mechanisms 140 thereby allowing for the glide assembly 100 to be secured to the float 200 at various locations on the float 200 and allowing for the glide assembly 100 to support multiple watercraft 300 of various sizes. For example, as shown in FIG. 8, a plurality of float cavities 141 can be positioned at various locations on the float 200. Preferably, three pairs of float cavities 141 are substantially located along the longitudinally axis of the watercraft receiving area 220 between about 6"-48", 6"-42", 6"-36", 6"-30", 6"-24", 6"-18", 6"-12", 12"-48", 12"-42", 12"-36", 12"-30", 12"-24", 12"-18", or the like, apart.

In one embodiment, the glide assembly 100 aids the float 200 in receiving the watercraft 300 by reducing the amount of friction between the bottom of the watercraft 300 and the surface of the watercraft receiving area 220. In one embodiment, the rotational function of the glide assembly 100 reduces the amount of force required to push or launch the watercraft 300 from the float 200 into the water. In one embodiment, the surface of the glide assembly 100 that contacts the watercraft 300 is located above the surface 221 of the watercraft receiving area 220 thereby reducing the amount of force required by the user to launch the watercraft 300 from the float 200. In one embodiment, the surface of the glide assembly 100 that contacts the watercraft 300 is located between about 1"-24", 1"-18", 1"-12", 1"-6", 3"-6", 3"-12", 3"-18", 3"-24", 6"-9", 6"-12", 6"-18", 6"-24", or the like, above the surface 221 of the watercraft receiving area 220. More specifically, the glide assembly 100 supports a portion of the watercraft 300 at a height above the surface 221 of the watercraft receiving area 220, and thereby provides for a portion of the watercraft 300 to be raised above the surface 221 of the watercraft receiving area 220. The portion of the watercraft 300 supported by the glide assembly 100 above the surface 221 of the watercraft receiving area 220 can be the bow 311, middle front 312, middle rear 313, or any combination thereof. This reduces the area of the bottom of the watercraft 300 that contacts the surface 221 of the watercraft receiving area 220 thereby which reduces the amount of resistance or friction between the surface 221 of the watercraft receiving area 220 and the watercraft 300, thereby reducing the amount of force required to launch the watercraft 300 from the float 200. In one embodiment, a plurality of glide assemblies 100 of substantially the same or various heights above the surface 221 of the watercraft receiving area 220 are positioned on the float 200.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

The foregoing has described the principles, embodiments, and modes of operation of the present invention. However, the invention should not be construed as being limited to the particular embodiments described above, as they should be regarded as being illustrative and not as restrictive. It should be appreciated that variations may be made in those embodiments by those skilled in the art without departing from the scope of the present invention.

Modifications and variations of the present invention are possible in light of the above teachings. It is therefore to be understood that the invention may be practiced otherwise than as specifically described herein.

What is claimed is:

1. A glide system comprising a glide assembly and a watercraft float, the glide assembly comprising:

a top surface, a base with a bottom surface and a cavity, a protrusion extending from the base, a glide member comprising an exterior surface, an axle, and a securing mechanism allowing for the glide assembly to be positioned at different locations on the watercraft float, wherein the cavity receives the glide member and axle, and the watercraft float comprising a watercraft receiving area, the watercraft receiving area comprising a track and a top surface, wherein the track extends the substantial length of the watercraft receiving area and is capable of slideably receiving the protrusion.

2. The glide system of claim 1 wherein the bottom surface of the glide assembly is substantially mated to the surface of the watercraft receiving area of the watercraft float.

3. The glide system of claim 1 wherein the contour of the protrusion has a substantially triangular shape, and the contour of the track has a substantially triangular shape.

4. The glide system of claim 1 wherein the contour of the exterior surface of the glide member is concave towards the center of the glide member.

5. The glide system of claim 1 wherein the securing mechanism comprises a threaded float cavity located within the watercraft float, an assembly tunnel located within the glide assembly, and a fastener.

6. The glide system of claim 5 wherein a plurality of threaded float cavities are located along the longitudinal axis of a watercraft receiving area of the watercraft float.

7. The glide system of claim 6 wherein the plurality of threaded float cavities are positioned between about 6"-48" apart.

8. The glide system of claim 1 wherein the top surface of the glide assembly is located above the top surface of the watercraft receiving area thereby reducing the amount of force required to launch the watercraft.

9. The glide system of claim 8 wherein the top surface of the glide assembly is located between about 1"-24" above the surface of the watercraft receiving area.

* * * * *